US011495376B2

(12) United States Patent
Luo et al.

(10) Patent No.: US 11,495,376 B2
(45) Date of Patent: Nov. 8, 2022

(54) RARE EARTH-BONDED MAGNETIC POWDER AND PREPARATION METHOD THEREFOR, AND BONDED MAGNET

(71) Applicants: GRIREM ADVANCED MATERIALS CO., LTD., Beijing (CN); GUOKE RE ADVANCED MATERIALS CO., LTD., Langfang (CN)

(72) Inventors: Yang Luo, Beijing (CN); Hongbin Zhang, Beijing (CN); Zhou Hu, Beijing (CN); Dunbo Yu, Beijing (CN); Ningtao Quan, Beijing (CN); Yuanfei Yang, Beijing (CN); Wenlong Yan, Beijing (CN); Jiajun Xie, Beijing (CN)

(73) Assignees: GRIREM ADVANCED MATERIALS CO., LTD., Beijing (CN); GUOKE RE ADVANCED MATERIALS CO., LTD., Langfang (CN)

( * ) Notice: Subject to any disclaimer, the term of this patent is extended or adjusted under 35 U.S.C. 154(b) by 34 days.

(21) Appl. No.: 16/612,294

(22) PCT Filed: Jun. 20, 2018

(86) PCT No.: PCT/CN2018/092020
§ 371 (c)(1),
(2) Date: Nov. 8, 2019

(87) PCT Pub. No.: WO2019/105013
PCT Pub. Date: Jun. 6, 2019

(65) Prior Publication Data

US 2021/0151226 A1 May 20, 2021

(30) Foreign Application Priority Data

Nov. 29, 2017 (CN) ..... 201711225326.4

(51) Int. Cl.
*B22F 1/02* (2006.01)
*H01F 1/057* (2006.01)
(Continued)

(52) U.S. Cl.
CPC ..... *H01F 1/0571* (2013.01); *B22F 1/16* (2022.01); *C22C 38/001* (2013.01);
(Continued)

(58) Field of Classification Search
None
See application file for complete search history.

(56) References Cited

U.S. PATENT DOCUMENTS 4,837,114 A * 6/1989 Hamada ..... H01F 1/0572 427/127
5,470,401 A * 11/1995 McCallum ..... B22F 1/02 148/301
(Continued)

FOREIGN PATENT DOCUMENTS

CN 101026034 A 8/2007
CN 101599329 A 12/2009
(Continued)

OTHER PUBLICATIONS

International Search Report of PCT/CN2018/092020.
Written Opinion of PCT/CN2018/092020.

*Primary Examiner* — Seth Dumbris
(74) *Attorney, Agent, or Firm* — Dragon Sun Law Firm, PC; Jinggao Li, Esq.; Nathaniel Perkins

(57) ABSTRACT

The present invention discloses rare earth-bonded magnetic powder and a preparation method therefor. The bonded magnetic powder is of a multilayer core-shell structure, and comprises a core layer and an antioxidant layer (3), wherein the core layer is formed by RFeMB, R is Nd and/or PrNd, and M is one or more of Co, Nb, and Zr; and the core layer
(Continued)

is coated with an iron-nitrogen layer (2). In addition, the present invention also discloses the preparation method for the rare earth-bonded magnetic powder and a bonded magnet. The oxidation and corrosion of magnetic raw powder during phosphorization and subsequent treatment process are effectively prevented, thereby further improving the long-term temperature resistance and environmental tolerance of the material.

20 Claims, 1 Drawing Sheet

(51) Int. Cl.

| | |
|---|---|
| ***C22C 38/00*** | (2006.01) |
| ***C22C 38/10*** | (2006.01) |
| ***C22C 38/12*** | (2006.01) |
| ***C22C 38/14*** | (2006.01) |
| ***B22F 1/16*** | (2022.01) |

(52) U.S. Cl.
CPC ..... *C22C 38/005* (2013.01); *C22C 38/10* (2013.01); *C22C 38/12* (2013.01); *C22C 38/14* (2013.01); *B22F 2201/02* (2013.01); *B22F 2301/355* (2013.01); *B22F 2302/20* (2013.01); *B22F 2302/45* (2013.01); *B22F 2304/10* (2013.01); *C22C 2202/02* (2013.01); *Y10T 428/12181* (2015.01)

(56) References Cited

U.S. PATENT DOCUMENTS

| | | | | |
|---|---|---|---|---|
| 5,916,376 | A | 6/1999 | Fukuno et al. | |
| 7,438,768 | B2 * | 10/2008 | Sakaki ..... | H01F 1/0557 148/303 |

FOREIGN PATENT DOCUMENTS

| | | | | |
|---|---|---|---|---|
| CN | 102789872 | A | | 11/2012 |
| CN | 104959618 | A | | 10/2015 |
| CN | 105206366 | A | | 12/2015 |
| CN | 105788792 | A | | 7/2016 |
| JP | 2014160794 | A | * | 9/2014 |

* cited by examiner

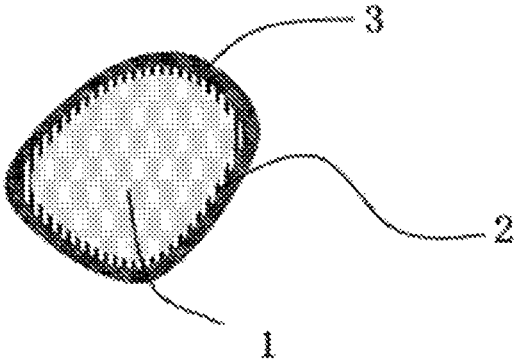
3
2
1

RARE EARTH-BONDED MAGNETIC POWDER AND PREPARATION METHOD THEREFOR, AND BONDED MAGNET

TECHNICAL FIELD

The present invention relates to rare earth-bonded magnetic powder, a preparation method therefor and a bonded magnet, and belongs to the technical field of rare earth materials.

BACKGROUND

At present, the NdFeB rare earth permanent magnet material has become an irreplaceable basic material in many fields, is widely used in many fields such as electronics, automobiles and computers, and drives the development of various industries. The conventional preparation method for a bonded magnet comprises: mixing rare earth-bonded magnetic powder having permanent magnetic properties with a resin binder (such as epoxy resin or nylon), and then performing compression molding or injection molding on the mixture. For the final magnet, the magnetic properties are mainly derived from the bonded magnetic powder, while the mechanical properties are mainly derived from the binder.

The rare earth permanent magnet material is generally required for operation at a certain temperature and environment, and is required to maintain the integrity of the external dimensions and the stability of the magnetic properties during long-term operation. For the bonded magnet, there are two key factors affecting the use performance, and the first factor is the binder. Although due to the binder, the bonded magnet has relatively strong advantages relative to a sintered magnet, the decomposition and softening temperature of the magnet is significantly lower than that of a metal material due to the defects of a high molecular material per se, which ultimately affects the properties of the material contained therein. Secondly, the bonded magnetic powder is externally coated with the high molecular material, but oxidation still occurs, and with the raise of the temperature, the oxidation occurs more easily. Such oxidation causes the remarkable increase of irreversible magnetic flux loss of the material, leading to the problems such as rusting and demagnetization of the magnet.

The oxidation of the magnet is generated in both the use process and the preparation process. As a result, not only is the poor product stability due to the safety hazards in preparation caused, but also great limitations on the expansion of the bonded magnet in the application field are generated.

At present, in the aspect of improving the oxidation resistance of the bonded magnetic powder, Chinese patent applications CN102498530A, CN101228024A, CN103503086A, and the like all mention the method of depositing an organic coating on the surface of the rare earth-bonded magnetic powder to form an organic passivation layer on the rare earth-bonded magnetic powder, thereby achieving the anti-aging purpose. Chinese patent CN1808648B also provides a surface treatment process for anisotropic bonded magnetic powder, in which anhydrous phosphorization treatment is performed on the anisotropic magnetic powder to prevent the oxidation of the anisotropic magnetic powder during high-temperature injection molding. In addition, Chinese patent applications CN103862033A and CN102744403A also mention a method for performing surface treatment on soft magnetic powder to reduce the eddy current loss of a soft magnetic powder core.

However, in all the above prior art, the modification is performed from the angle of surface chemical treatment of the powder, but in the chemical treatment, the material is still oxidized to some extent due to the inevitable contact with oxygen, water, and the like which cause corrosion.

Therefore, in view of the deficiencies of the prior art, there is still a need to further explore a surface treatment process with more advantageous performance.

SUMMARY

An object of the present invention is to provide rare earth-bonded magnetic powder and a preparation method therefor to further improve the oxidation resistance and corrosion resistance of the rare earth-bonded permanent magnetic powder.

In order to solve the problem, the present invention adopts the following technical solution.

According to the rare earth-bonded magnetic powder, the bonded magnetic powder is of a multilayer core-shell structure and comprises a core layer and an antioxidant layer, wherein the core layer is formed by RFeMB, R is Nd and/or PrNd, and M is one or more of Co, Nb, and Zr; and the core layer is externally coated with an iron-nitrogen layer.

According to the rare earth-bonded magnetic powder of the present invention, in the RFeMB, the content of R is 20-30 wt %, the content of M is 0-6 wt %, the content of B is 0.85-1.05 wt %, and the balance is Fe.

According to the rare earth-bonded magnetic powder of the present invention, the iron-nitrogen layer is formed by an iron-nitrogen compound, and the iron-nitrogen layer has a thickness of 50-500 nm, preferably 100-400 nm, more preferably 150-350 nm, and most preferably 200-300 nm.

According to the rare earth-bonded magnetic powder of the present invention, the antioxidant layer is formed by a phosphate composite, and has a thickness of 10-200 nm, preferably 20-160 nm and most preferably 50-80 nm.

In another aspect, the present invention also provides a preparation method for the above rare earth-bonded magnetic powder. The preparation method comprises the following steps: performing surface nitriding treatment on magnetic raw powder to obtain nitrided powder, wherein the nitriding temperature is 300-550° C., and the time is 10-120 min; preferably, the nitriding temperature is 350-550° C., and the time is 10-100 min; more preferably, the nitriding temperature is 400-550° C., and the time is 10-60 min; and most preferably, the nitriding temperature is 450-550° C., and the time is 10-30 min; preparing an antioxidant solution; immersing the nitrided powder in the antioxidant solution and performing drying to obtain the bonded magnetic powder of a core-shell structure.

According to the preparation method of the present invention, the nitriding treatment is the reaction between the magnetic raw powder and a nitrogen-containing atmosphere.

Preferably, the nitrogen-containing atmosphere is mainly formed by nitrogen without containing ammonia and hydrogen.

According to the preparation method of the present invention, the antioxidant solution is a solution formed by dissolving phosphoric acid or a salt thereof in an organic solvent, and the ratio of the antioxidant to the organic solvent is (0.1-5)g:100 ml.

According to the preparation method of the present invention, the drying temperature is 80-110° C., preferably 85-105° C., more preferably 90-105° C., and most preferably 95-105° C.

The present invention also provides a bonded magnet, comprising the rare earth-bonded magnetic powder described above or prepared by the above method.

By the above method, an additional layer can be formed on the surface of the bonded magnetic powder for protection, thereby avoiding the influence of introduction of oxygen and the like on the performance in the subsequent chemical treatment process, improving the effect of the subsequent chemical treatment, and greatly improving the oxidation resistance, corrosion resistance and performance stability at high temperatures of the bonded magnet.

BRIEF DESCRIPTION OF THE DRAWINGS

FIG. 1 is a schematic diagram of the surface multilayer structure of rare earth-bonded magnetic powder according to the present invention.

DETAILED DESCRIPTION

The objects and/or solutions of the present invention will be given in the form of preferred embodiments. The description of these embodiments is intended to be illustrative of the present invention rather than limiting the other feasible embodiments and these other feasible embodiments can be known by the practice of the present invention.

The present invention is further illustrated by the following embodiments, but it is apparent that the scope of the present invention is not limited to the following embodiments.

As shown in FIG. 1, in the present invention, the rare earth-bonded magnetic powder is of a multilayer core-shell structure, wherein a core layer is magnetic raw powder 1 with the component RFeMB, and the core layer is externally coated with an iron-nitrogen layer 2 and an antioxidant layer 3 in sequence. The iron-nitrogen layer 2 and the antioxidant layer 3 are respectively formed by different processes in sequence.

The preferred component of the magnetic raw powder 1 of the present invention is RFeMB, where R is Nd and/or PrNd, and M is one or more of Co, Nb, and Zr. The main phase structure of the magnetic raw powder 1 is $Nd_2Fe_{14}B$. In the present invention, the "main phase" means a crystal phase which forms the main body of the structure and properties of the material and dominates the properties of the material. In the present invention, the main phase $Nd_2Fe_{14}B$ forms the basis of the permanent magnet properties, thereby ensuring that the final magnetic powder has certain magnetic properties such as remanent magnetism and coercive force. It will be understood by those skilled in the art that in addition to the main phase, the RFeMB according to the present invention may also comprise a certain amount of auxiliary phase such as α-Fe, yttrium-rich phase, and iron-boron. The auxiliary phase is mainly introduced by component adjustment during the optimization of the preparation process. The addition amount of the auxiliary phase is also a usual addition amount in the art.

In the present invention, the content of R is preferably 20-30 wt %, the content of M is 0-6 wt %, the content of B is 0.85-1.05 wt %, and the balance is Fe. These component ranges are necessary for ensuring the certain main phase structure and the permanent magnet properties. In addition, a small amount of Co, Nb and Zr is added to improve the temperature resistance, corrosion resistance and molding properties of the rare earth-bonded magnetic powder. In one embodiment, when M is Co, the content of Co is 2-6 wt %.

In the present invention, the magnetic raw powder 1 may be prepared by methods well known in the art including, but not limited to, rapid quenching, gas atomization, and the like.

By taking the rapid quenching method as an example, in the method, flaky rare earth alloy powder is mainly formed by spraying a molten alloy solution onto a high-speed rotating roller by a nozzle and then performing rapid cooling.

In the rapid quenching method, the molten alloy solution is mainly obtained by an intermediate frequency or high frequency induction melting method, the melting speed in the induction melting is high, and the solution is stirred during the melting process to ensure melting uniformity and avoid component segregation. The molten alloy solution is sprayed onto the high-speed rotating roller by the nozzle. The nozzle may be made of a high-temperature refractory material such as quartz, BN and $Al_2O_3$, and the pore diameter is 0.5-2 mm. The roller may be made of a material with good thermal conductivity such as copper, copper alloy, carbon steel, W and Mo. By comprehensively considering the characteristics of the preparation of the material, the wettability of the molten alloy solution and the roller, the strength and wear resistance of the material and the like, the roller is preferably made of copper, copper alloy, Mo or Mo alloy. The diameter of the roller is preferably 250 mm to 500 mm, and a water path is disposed inside the roller to ensure the temperature of the roller, so that a large temperature gradient is formed with respect to the molten alloy, and there is no time for the alloy sprayed onto the roller to nucleate or grow, so as to obtain the amorphous or nanometer crystalline flaky rare earth alloy powder.

The entire rapid quenching process is carried out in a non-oxidizing atmosphere, which mainly contains Ar preferably, and the pressure range P of Ar in the environment is 10-80 kPa, and preferably 20-60 kPa. The rare earth alloy powder which is in contact with the roller and thrown away is once cooled in the non-oxidizing atmosphere during the flying out process. If the pressure is lower than 10 kPa, the rapid cooling effect cannot be achieved. If the pressure is too high, it is not favorable for full wetting of the solution and the roller during the rapid quenching process, which affects the surface roughness state of the final magnetic powder, and is not conducive to the preparation of the entire rare earth-bonded magnetic powder.

In the rapid quenching process, smelting and rapid quenching may be carried out in one cavity. At this point, the smelting and the rapid quenching are under the same ambient pressure, and the molten steel is sprayed out from the nozzle by dead weight. The smelting and the rapid quenching may also be carried out in two independent cavities, which are connected by the nozzle in the middle, and the spraying speed and the spraying stability are adjusted by adjusting the pressure of the smelting cavity.

After finishing the rapid quenching process, the magnetic raw powder obtained by the rapid quenching is collected for further processing, that is, the nitriding treatment and anti-oxidation treatment.

In the present invention, the iron-nitrogen layer having a thickness of 50-500 nm is formed on the outer layer of the magnetic raw powder 1 by the nitriding treatment. The iron-nitrogen layer takes iron-nitrogen compounds as the main components, including $Fe_4N$, $Fe_2N$, $Fe_3N$ and the like. The iron-nitrogen compounds are mainly formed by enabling a material containing Fe to react with a nitrogen-containing atmosphere, and have the main function of preventing the magnetic raw material 1 of the core layer from, in the subsequent process of forming the antioxidant layer 3 and the subsequent molding process, being in contact with water, air and the like, which causes oxidation of the magnetic raw material 1 and consequently affects the subsequent performance. In the present invention, the iron-nitrogen compounds are mainly formed through the reaction between the RFeMB and the nitrogen-containing atmosphere.

The reaction needs to be carried out at a certain temperature. Advantageously, the reaction temperature is 300-550° C. and the time is 10-120 min.

In the present invention, the thickness of the iron-nitrogen layer 2 is 50-500 nm, which ensures the formation of the iron-nitrogen layer without a significant decrease in the magnetic properties of the core portion. Preferably, the thickness of the iron-nitrogen layer 2 is 100-400 nm. More preferably, the thickness of the iron-nitrogen layer 2 is 150-350 nm. Most preferably, the thickness of the iron-nitrogen layer 2 is 200-300 nm.

In a specific embodiment, the thickness of the iron-nitrogen layer 2 is 250 nm.

In the present invention, the iron-nitrogen layer 2 is externally coated with the antioxidant layer 3, and the antioxidant layer is preferably a phosphate compound. The phosphate compound is formed by enabling phosphoric acid or phosphate to react with the magnetic raw powder 1 and the iron-nitrogen layer 2. The phosphated layer 3 forms a second protection barrier for the core portion, thereby effectively preventing the oxidation and corrosion of the core portion.

In the present invention, the thickness of the antioxidant layer is 10-200 nm. If the antioxidant layer is too thick, the improvement of the magnetic properties is affected. If the antioxidant layer is too thin, the protective effect is not obtained. Preferably, the thickness of the antioxidant layer is 20-160 nm. More preferably, the thickness of the antioxidant layer is 40-120 nm. Most preferably, the thickness of the antioxidant layer is 50-80 nm.

In a specific embodiment, the thickness of the antioxidant layer is 60 nm.

In another aspect, the present invention also relates to a preparation method for the rare earth-bonded magnetic powder. The preparation method mainly comprises the following steps.

(1) Step of Performing Surface Nitriding Treatment on the Magnetic Raw Powder to Obtain Nitrided Powder This step is mainly used to form an iron-nitrogen layer 1. In the process, the atmosphere of the nitriding treatment is preferably nitrogen. Although other atmospheres such as $N_2+H_2$ and $NH_3+H_2$ can improve the nitriding efficiency, the decomposition of the main phase $Nd_2Fe_{14}B$ is inevitably caused, which seriously affects the properties of the final magnetic powder. The key of this step is to form certain distribution of nitrogen in the magnetic raw powder, so that the nitrogen is concentrated on the surface layer of the magnetic powder, and enters the crystal lattices of the main phase $Nd_2Fe_{14}B$ of the magnetic powder as little as possible to keep the main phase stable.

In the present invention, the nitriding temperature is 300-550° C. and the time is 10-120 min. Preferably, the nitriding temperature is 350-550° C., and the time is 10-100 min. More preferably, the nitriding temperature is 400-550° C., and the time is 10-60 min. Most preferably, the nitriding temperature is 450-550° C., and the time is 10-30 min.

In a specific embodiment, the nitriding temperature is 500° C. and the time is 20 min.

(2) Step of Preparing an Antioxidant Solution

An antioxidant is dissolved in an organic solvent to form a solution. The antioxidant comprises phosphoric acid or phosphate. The phosphoric acid is preferably anhydrous phosphoric acid to prevent water from reacting with the magnetic raw powder 1 and the nitrided layer 2. The phosphate is preferably phosphate selected from IA group metals, HA group metals and IIIA group metals. The organic solvent is preferably acetone or alcohol. Not only can the antioxidant be sufficiently dissolved, but also the antioxidant can be completely volatilized to be solidified after the antioxidant is sufficiently uniformly attached.

In the present invention, the ratio of the antioxidant to the organic solvent is (0.1-5)g:100 mL. Preferably, the ratio of the antioxidant to the organic solvent is (0.2-4)g:100 mL. More preferably, the ratio of the antioxidant to the organic solvent is (0.4-3)g:100 mL. Most preferably, the ratio of the antioxidant to the organic solvent is (0.6-2)g:100 mL.

In a specific embodiment, the ratio of the antioxidant to the organic solvent is 1.2 g:100 mL.

(3) The Step of Immersing Nitrided Powder in the Antioxidant Solution, and then Performing Drying to Obtain the Bonded Magnetic Powder of a Core-Shell Structure In this step, the magnetic powder and the antioxidant are prepared according to a certain ratio and are placed in the antioxidant solution for full reaction by agitation preferably, which is more favorable for the uniform reaction of the magnetic powder and the antioxidant. After reaction and filtration are completed, drying is performed.

In the present invention, the drying temperature is 80-110° C. Preferably, the drying temperature is 85-105° C. More preferably, the drying temperature is 90-105° C. Most preferably, the drying temperature is 95-105° C.

In yet another aspect, the present invention also comprises a bonded magnet obtained by the above preparation method.

Compared with the prior art, the present invention has the greatest advantage that the nitriding treatment step is added before the conventional phosphorization step, thereby forming the nitrided layer 2 between the magnetic raw powder 1 and the antioxidant layer 3, effectively avoiding the oxidation and corrosion of the magnetic raw powder during the phosphorization and subsequent treatment process and further improving the long-term temperature resistance and environmental tolerance of the material.

DETAILED EMBODIMENTS

The present invention will now be further described below in detail by way of embodiments.

Embodiments 1 to 25

The various raw materials (Nd, NdPr, Fe, Co, B, Zr and Nb) of each of embodiments No. 1 to No. 9 listed in Table 1 are mixed in proportion and then placed in an induction melting furnace for melting under the protection of Ar to obtain an alloy ingot.

The alloy ingot is coarsely crushed and placed in a rapid quenching furnace for rapid quenching, and magnetic raw powder is obtained after the rapid quenching.

The rare earth alloy powder having an average thickness of 15-100 μm is thus prepared, and the obtained rare earth alloy powder is subjected to XRD to determine the phase structure.

The above magnetic raw powder is treated under the protection of Ar at a certain temperature for certain time, and then nitrided under $N_2$ to form an iron-nitrogen layer on the surface of the magnetic raw powder.

The antioxidant is dissolved in an organic solvent to form a solution.

The nitrided powder is immersed in the antioxidant solution, and then drying is performed to obtain the bonded magnetic powder of a core-shell structure.

Comparative Example No. 1

The surface nitriding treatment step is omitted, and the remaining steps are the same as those in Embodiment 1.

Comparative Example No. 2

Reference is made to Table 1 for details.

TABLE 1

| Experiment | Magnetic raw powder 1 | Nitrogen-containing atmosphere | Nitriding temperature and time | Thickness of iron-nitrogen layer | Antioxidant solution | Drying temperature | Thickness of antioxidant layer |
|---|---|---|---|---|---|---|---|
| No. 1 | $Nd_{20}Co_6B_{1.0}Fe_{bal}$ | $N_2$ | 500° C., 20 min | 250 nm | Ratio of antioxidant to organic solvent: 1.2 g:100 ml | 100° C. | 50 nm |
| No. 2 | $Nd_{25}Co_2B_{1.0}Fe_{bal}$ | $N_2$ | 450° C., , 30 min | 200 nm | Ratio of antioxidant to organic solvent: 0.6 g:100 ml | 95° C. | 50 nm |
| No. 3 | $Nd_{30}Nb_5B_{0.85}Fe_{bal}$ | $N_2$ | 550° C., 10 min | 300 nm | Ratio of antioxidant to organic solvent: 2 g:100 ml | 105° C. | 80 nm |
| No. 4 | $Nd_{26}Zr_4B_{0.85}Fe_{bal}$ | $N_2$ | 300° C., 120 min | 50 nm | Ratio of antioxidant to organic solvent: 0.1 g:100 ml | 80° C. | 10 nm |
| No. 5 | $Nd_{15}(PrNd)_{12}B_{1.0}Fe_{bal}$ | $N_2$ | 550° C., 30 min | 500 nm | Ratio of antioxidant to organic solvent: 5 g:100 ml | 110° C. | 200 nm |
| No. 6 | $(PrNd)_{21}Nb_2Co_3B_{0.9}Fe_{bal}$ | $N_2$ | 350° C., 100 min | 100 nm | Ratio of antioxidant to organic solvent: 0.2 g:100 ml | 85° C. | 20 nm |
| No. 7 | $(PrNd)_{30}Nb_3Zr_2B_{1.05}Fe_{bal}$ | $N_2$ | 400° C., 60 min | 400 nm | Ratio of antioxidant to organic solvent: 4 g:100 ml | 105° C. | 160 nm |
| No. 8 | $(PrNd)_{26}Nb_{2.5}Zr_2B_{1.05}Fe_{bal}$ | $N_2$ | 550° C., 25 min | 300 nm | Ratio of antioxidant to organic solvent: 1.5 g:100 ml | 100° C. | 80 nm |
| No. 9 | $(PrNd)_{21}Zr_2Co_3B_{0.9}Fe_{bal}$ | $N_2$ | 500° C., 22 min | 250 nm | Ratio of antioxidant to organic solvent: 2 g:100 ml | 105° C. | 60 nm |
| No. 10 | $(PrNd)_{25}Zr_1Co_2B_{1.0}Fe_{bal}$ | $N_2$ | 450° C., 20 min | 150 nm | Ratio of antioxidant to organic solvent: 0.4 g:100 ml | 90° C. | 60 nm |
| No. 11 | $Nd_{20}(PrNd)_{10}Zr_1Co_1B_{1.0}Fe_{bal}$ | $N_2$ | 400° C., 50 min | 350 nm | Ratio of antioxidant to organic solvent: 3 g:100 ml | 90° C. | 50 nm |
| Comp. No. 1 | $Nd_{20}Co_6B_{1.0}Fe_{bal}$ | | | | Ratio of antioxidant to organic solvent: 1.2 g:100 ml | 100° C. | 60 nm |

TABLE 1-continued

| Experiment | Magnetic raw powder 1 | Nitrogen-containing atmosphere | Nitriding temperature and time | Thickness of iron-nitrogen layer | Antioxidant solution | Drying temperature | Thickness of antioxidant layer |
|---|---|---|---|---|---|---|---|
| Comp. No. 2 | $Nd_{15}(PrNd)_{12}B_{1.0}Fe_{bal}$ | $N_2$ | 200° C., 120 min | 20 nm | Ratio of antioxidant to organic solvent: 0.1 g:100 ml | 80° C. | 10 nm |

Evaluation Method for Magnetic Powder Performance (1) Component of Rare Earth-Bonded Magnetic Powder The component of the rare earth-bonded magnetic powder is a component obtained after the heat treatment and nitriding treatment are performed on the rapidly quenched rare earth alloy powder, and the component is expressed by atomic percentage.

(2) Magnetic Powder Performance

The magnetic powder performance is measured by a vibrating sample magnetometer (VSM detection).

Br is remanent magnetism and the unit is kGs.

Hcj is the intrinsic coercive force and the unit is kOe.

(BH)m is magnetic energy product and the unit is MGOe.

(3) Corrosion Resistance η

Firstly, the nitrided rare earth-bonded magnetic powder is sieved by a 300-mesh sieve, the fine powder having a particle size of less than 50 μm is taken out, and the mass of the rare earth-bonded magnetic powder without the fine powder is weighed as W1.

The magnetic powder is treated in a 5% NaCl aqueous solution at 80° C. for 48 h, after being dried, the treated magnetic powder is sieved by the 300-mesh sieve again, and the mass of the treated rare earth-bonded magnetic powder is weighed as W2.

$$\text{Corrosion resistance } \eta=(W1-W2)/W1.$$

Samples with the loss of less than 1 wt % are considered to be qualified in corrosion resistance.

(4) Temperature Resistance

The temperature resistance is measured with an irreversible magnetic flux loss of 1000 h at 120° C.

Table 2 shows the components, magnetic powder performance, corrosion resistance η, and temperature resistance of the rare earth-bonded magnetic powder of Embodiments No. 1-9 according to the present application and Comparative Examples No. 1 and 2.

TABLE 2

| Experiment | Component of permanent magnetic powder | Br | Hcj | (BH)m | η | Irreversible magnetic flux loss |
|---|---|---|---|---|---|---|
| No. 1 | $Nd_{8.4}Co_6B_{5.6}N_{1.1}Fe_{bal}$ | 8.5 | 12.3 | 15.2 | 0.25% | 2.7% |
| No. 2 | $Nd_{10.8}Co_{2.1}B_{5.8}N_{0.9}Fe_{bal}$ | 8.7 | 12.5 | 15.5 | 0.60% | 3.5% |
| No. 3 | $Nd_{13.8}Nb_{3.6}B_{5.2}N_{1.4}Fe_{bal}$ | 8.2 | 12 | 14.7 | 0.35% | 3.0% |
| No. 4 | $Nd_{11.7}Zr_{2.9}B_5N_{0.3}Fe_{bal}$ | 8.8 | 12.7 | 15.8 | 0.80% | 3.8% |
| No. 5 | $Nd_{7.8}Pr_4B_{5.8}N_{2.3}Fe_{bal}$ | 7.8 | 11.7 | 14.2 | 0.50% | 3.2% |
| No. 6 | $Nd_{2.6}Pr_{6.6}Nb_{1.3}Co_{3.1}B_{5.1}N_{0.44}Fe_{bal}$ | 8.7 | 12.6 | 15.7 | 0.70% | 3.6% |
| No. 7 | $Nd_{3.6}Pr_{10.2}Nb_{2.1}Zr_{1.4}B_{6.3}N_{1.9}Fe_{bal}$ | 8 | 11.8 | 14.5 | 0.55% | 3.3% |
| No. 8 | $Pr_{3.1}Nd_{9.0}Nb_{1.8}Zn_{1.3}B_{5.1}N_{1.5}Fe_{bal}$ | 9.2 | 13.0 | 14.2 | 0.20% | 2.0% |
| No. 9 | $Nd_{2.4}Pr_{6.5}Nb_{1.2}Co_{3.0}B_{5.0}N_{1.2}Fe_{bal}$ | 9.0 | 13.2 | 14.0 | 0.22% | 2.1% |
| No. 10 | $Nd_{2.6}Pr_{8.5}Co_{2.1}Zr_{0.7}B_{5.8}N_{0.7}Fe_{bal}$ | 8.5 | 12.4 | 15.6 | 0.65% | 3.4% |
| No. 11 | $Nd_{10.3}Pr_{3.2}Co_{1.1}Zr_{0.7}B_6N_{1.6}Fe_{bal}$ | 8.1 | 12.1 | 14.6 | 0.40% | 3.1% |
| Comp. No. 1 | $Nd_{8.4}Co_6B_{5.6}N_{1.1}Fe_{bal}$ | 8.4 | 11.9 | 15.2 | 1.20% | 4.2% |
| Comp. No. 2 | $Nd_{11.7}Zr_{2.9}B_5N_{0.1}Fe_{bal}$ | 7.8 | 11.7 | 13.8 | 1.40% | 5.3% |

It can be seen that compared with the comparative examples, the embodiments No. 1-9 according to the present application effectively avoid the oxidation and corrosion of the magnetic raw powder during the phosphorization and subsequent treatment process, thereby further improving the long-term temperature resistance and environment tolerance of the material. The foregoing is only the preferred embodiments of the present invention, and is not intended to limit the present invention, and for those skilled in the art, various modifications and changes can be made to the present invention. Any modifications, equivalent substitutions, improvements, and the like, which are made within the spirit and principle of the present invention are intended to be included within the protection scope of the present invention.

What is claimed is:

1. Rare earth-bonded magnetic powder, wherein the bonded magnetic powder is of a multilayer core-shell structure and comprises a core layer and an antioxidant layer, wherein the core layer is formed by RFeMB, R is Nd and/or PrNd, and M is one or more of Co, Nb, and Zr; and the core layer is externally coated with an iron-nitrogen layer and the antioxidant layer in sequence.

2. The rare earth-bonded magnetic powder according to claim 1, wherein in the RFeMB, the content of R is 20-30 wt %, the content of M is 0-6 wt % (excluding 0), the content of B is 0.85-1.05 wt %, and the balance is Fe.

3. The rare earth-bonded magnetic powder according to claim 1, wherein the iron-nitrogen layer is formed by an iron-nitrogen compound and has a thickness of 50-500 nm.

4. The rare earth-bonded magnetic powder according to claim 1, wherein the antioxidant layer is formed by a phosphate composite and has a thickness of 10-200 nm.

5. A preparation method for the rare earth-bonded magnetic powder according to any one of claim 1, wherein the preparation method comprises the following steps: performing surface nitriding treatment on magnetic raw powder to obtain nitrided powder, wherein the nitriding temperature is 300-550° C., and the time is 10-120 min;

preparing an antioxidant solution; and immersing the nitrided powder in the antioxidant solution and performing drying to obtain the bonded magnetic powder of a core-shell structure.

6. The method according to claim 5, wherein the nitriding treatment is the reaction between the magnetic raw powder and a nitrogen-containing atmosphere.

7. The method according to claim 6, wherein the nitrogen-containing atmosphere is mainly formed by nitrogen without containing ammonia and hydrogen.

8. The method according to claim 5, wherein the antioxidant solution is a solution formed by dissolving phosphoric acid or a salt thereof in an organic solvent, and the ratio of the antioxidant to the organic solvent is (0.1-5)g:100 ml.

9. The method according to claim 5, wherein the drying temperature is 80-110° C.

10. A bonded magnet, comprising the rare earth-bonded magnetic powder according to claim 1.

11. The method according to claim 5, wherein in the RFeMB, the content of R is 20-30 wt %, the content of M is 0-6 wt % (excluding 0), the content of B is 0.85-1.05 wt %, and the balance is Fe.

12. The method according to claim 5, wherein the iron-nitrogen layer is formed by an iron-nitrogen compound and has a thickness of 50-500 nm.

13. The method according to claim 5, wherein the antioxidant layer is formed by a phosphate composite and has a thickness of 10-200 nm.

14. The method according to claim 10, wherein in the RFeMB, the content of R is 20-30 wt %, the content of M is 0-6 wt % (excluding 0), the content of B is 0.85-1.05 wt %, and the balance is Fe.

15. The method according to claim 10, wherein the iron-nitrogen layer is formed by an iron-nitrogen compound and has a thickness of 50-500 nm.

16. The method according to claim 10, wherein the antioxidant layer is formed by a phosphate composite and has a thickness of 10-200 nm.

17. The rare earth-bonded magnetic powder according to claim 3, wherein the iron-nitrogen layer is formed by an iron-nitrogen compound and has a thickness of 150-350 nm.

18. The rare earth-bonded magnetic powder according to claim 3, wherein the iron-nitrogen layer is formed by an iron-nitrogen compound and has a thickness of 200-300 nm.

19. The rare earth-bonded magnetic powder according to claim 4, wherein the antioxidant layer is formed by a phosphate composite and has a thickness of 20-160 nm.

20. The rare earth-bonded magnetic powder according to claim 4, wherein the antioxidant layer is formed by a phosphate composite and has a thickness of 50-80 nm.

* * * * *